US005612596A

United States Patent [19]

Wiese

[11] Patent Number: 5,612,596

[45] Date of Patent: Mar. 18, 1997

[54] CONSERVATION TRAFFIC CONTROL LOAD SWITCH

[75] Inventor: Paul H. Wiese, Westerville, Ohio

[73] Assignee: Conservation Load Switch, Inc., Westerville, Ohio

[21] Appl. No.: 543,300

[22] Filed: Oct. 16, 1995

[51] Int. Cl.[6] ..... H05B 37/00

[52] U.S. Cl. ..... 315/291; 315/307; 315/DIG. 7; 340/907; 340/912

[58] Field of Search ..... 340/907, 911, 340/912, 916; 315/291, 294, 307, DIG. 4, DIG. 7, 297, 200 R, 246, 224, 225

[56] References Cited

U.S. PATENT DOCUMENTS

| | | | |
|---|---|---|---|
| 3,605,084 | 9/1971 | Matysek | 340/40 |
| 4,320,964 | 3/1982 | Ishida | 355/69 |
| 4,371,812 | 2/1983 | Widmayer | 315/291 |
| 4,379,254 | 4/1983 | Hurban | 315/291 |
| 4,408,180 | 10/1983 | Metz | 340/909 |
| 4,478,468 | 10/1984 | Schoen et al. | 315/291 |
| 4,528,482 | 7/1985 | Merlo | 315/291 |
| 4,568,858 | 2/1986 | Matsul | 315/198 |
| 4,574,223 | 3/1986 | Pitel | 315/307 |
| 4,680,536 | 7/1987 | Roszel et al. | 323/321 |
| 4,713,721 | 12/1987 | Pelonis | 361/100 |
| 4,888,678 | 12/1989 | Sundhar | 363/146 |
| 5,365,162 | 11/1994 | Sundhar | 323/320 |

*Primary Examiner*—Robert Pascal
*Assistant Examiner*—David Vu
*Attorney, Agent, or Firm*—Mueller and Smith, LPA

[57] ABSTRACT

A solid state load switching conservation circuit removably connectable with a control output of a traffic control logic circuit and responsive to an actuating input to energize an incandescent lamp from an a.c. power source exhibiting a given voltage level. The switching circuit conserves electrical power consumption and the life span of incandescent lamps and, in this regard, employs a thyristor switch, triac driver, shunting network, voltage level monitoring network, a.c. cycle monitoring network, and processor to provide a soft start form of turn on for the lamps being energized. Subsequent to the completion of soft start control, the conservation approach of the invention then turns to a voltage regulation mode which regulates the voltage applied to the lamp during traffic logic control illumination intervals such that the lamp is energized at an acceptable but lowered RMS voltage to conserve both energy and lamp life spans. Additionally employed is a failsafe approach wherein reversion is made to the standard lamp illuminating function of the traffic control logic circuit should the conservation based components of the switching circuit fail.

20 Claims, 9 Drawing Sheets

OSC1
OSC2
RESET
IRQ
PCO
PC1
PC2
PC5
PC6
PC7/VRH
PA2
PA1
PA0
VCC
V0
V1
GND
R1
R2
R3
R4
R5
R6
R7
R8
C1
C2
C3
C4
C5
C6
C7
C8
D1
T1
60
62
64
66
67
68
70
71
72
74
76
78
80
82
84
86
88
90
92
94
100
102
104
106
108
110
112
113
114
116
118
120
122
124
125
126
128
129
130
132
133
134
136
137
138
140
141
142
144
145
146
147
148
149

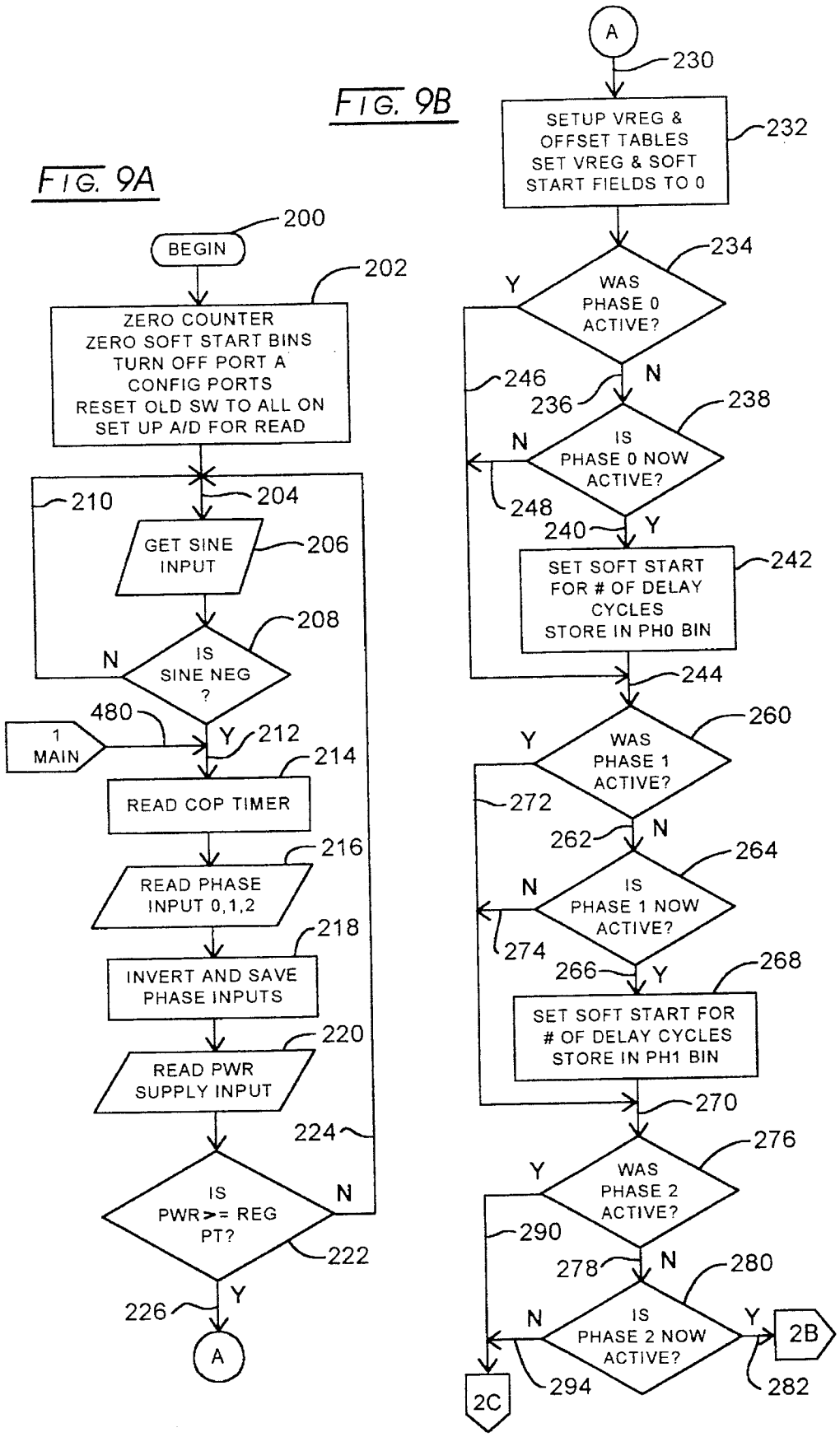
FIG. 9A
FIG. 9B
BEGIN
200
ZERO COUNTER
ZERO SOFT START BINS
TURN OFF PORT A
CONFIG PORTS
RESET OLD SW TO ALL ON
SET UP A/D FOR READ
202
204
210
GET SINE INPUT
206
IS SINE NEG ?
208
N
Y
1 MAIN
480
212
READ COP TIMER
214
READ PHASE INPUT 0,1,2
216
INVERT AND SAVE PHASE INPUTS
218
READ PWR SUPPLY INPUT
220
224
IS PWR >= REG PT?
222
N
Y
226
A
A
230
SETUP VREG & OFFSET TABLES
SET VREG & SOFT START FIELDS TO 0
232
WAS PHASE 0 ACTIVE?
234
Y
N
246
236
IS PHASE 0 NOW ACTIVE?
238
N
248
240
Y
SET SOFT START FOR # OF DELAY CYCLES STORE IN PH0 BIN
242
244
WAS PHASE 1 ACTIVE?
260
Y
272
262
N
IS PHASE 1 NOW ACTIVE?
264
N
274
266
Y
SET SOFT START FOR # OF DELAY CYCLES STORE IN PH1 BIN
268
270
WAS PHASE 2 ACTIVE?
276
Y
290
278
N
IS PHASE 2 NOW ACTIVE?
280
N
Y
2B
2C
294
282

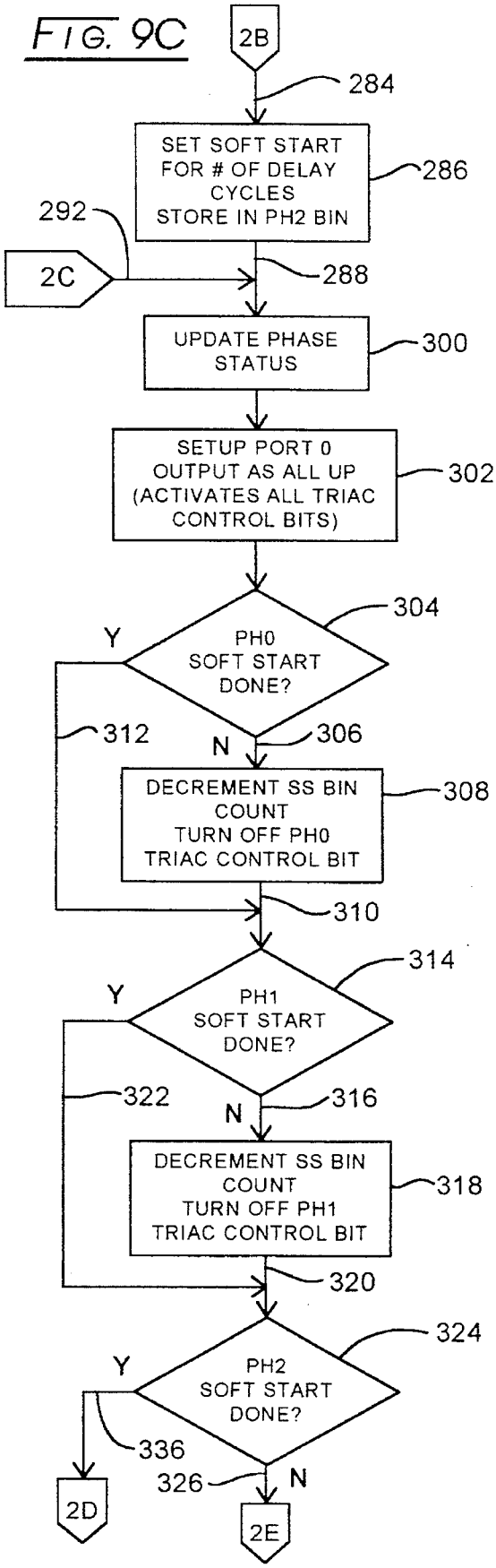
FIG. 9C
2B
284
SET SOFT START FOR # OF DELAY CYCLES STORE IN PH2 BIN
286
292
2C
288
UPDATE PHASE STATUS
300
SETUP PORT 0 OUTPUT AS ALL UP (ACTIVATES ALL TRIAC CONTROL BITS)
302
PH0 SOFT START DONE?
304
Y
312
N
306
DECREMENT SS BIN COUNT TURN OFF PH0 TRIAC CONTROL BIT
308
310
PH1 SOFT START DONE?
314
Y
322
N
316
DECREMENT SS BIN COUNT TURN OFF PH1 TRIAC CONTROL BIT
318
320
PH2 SOFT START DONE?
324
Y
336
2D
326
N
2E

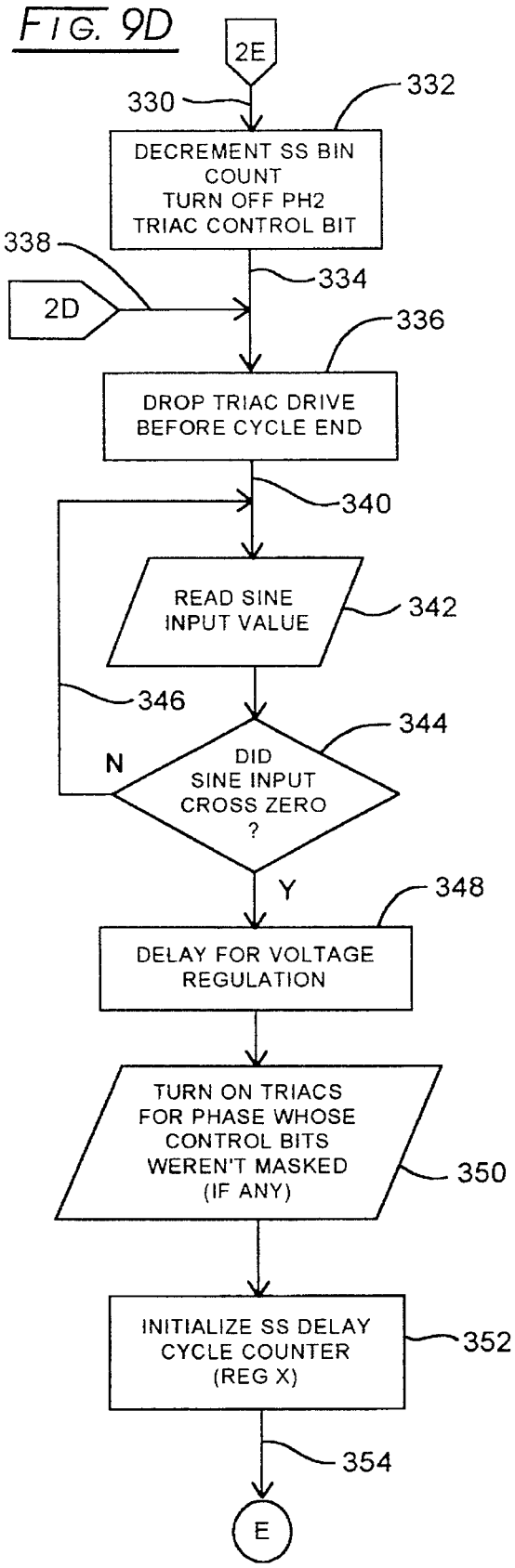
FIG. 9D
2E
330
332
DECREMENT SS BIN COUNT TURN OFF PH2 TRIAC CONTROL BIT
338
334
2D
336
DROP TRIAC DRIVE BEFORE CYCLE END
340
READ SINE INPUT VALUE
342
346
344
N
DID SINE INPUT CROSS ZERO ?
Y
348
DELAY FOR VOLTAGE REGULATION
TURN ON TRIACS FOR PHASE WHOSE CONTROL BITS WEREN'T MASKED (IF ANY)
350
INITIALIZE SS DELAY CYCLE COUNTER (REG X)
352
354
E

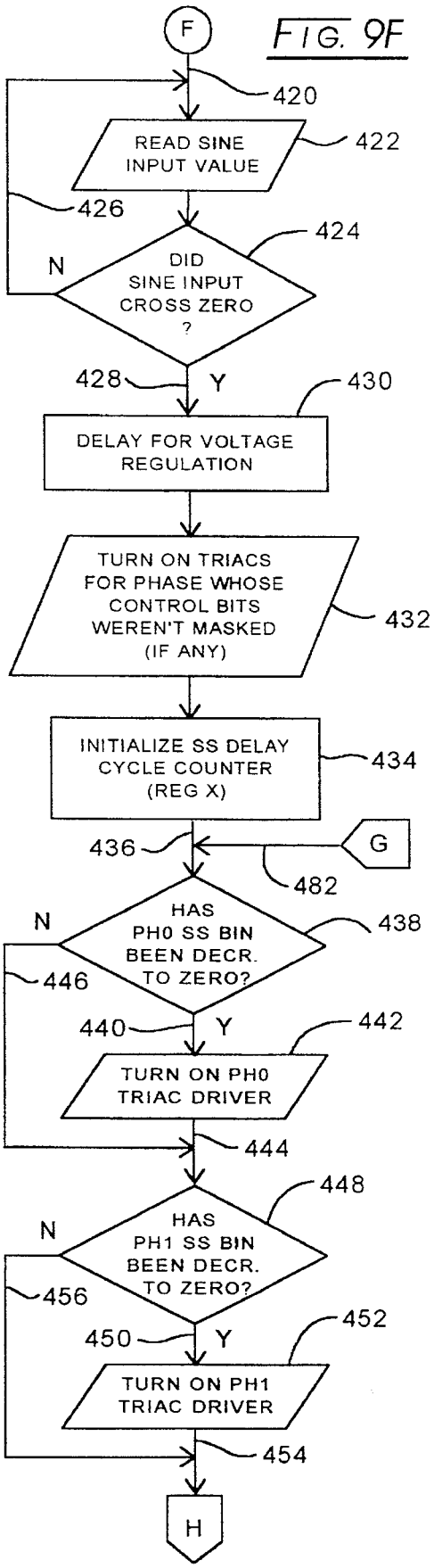
F
FIG. 9F
420
READ SINE INPUT VALUE
422
426
424
N
DID SINE INPUT CROSS ZERO ?
428
Y
430
DELAY FOR VOLTAGE REGULATION
TURN ON TRIACS FOR PHASE WHOSE CONTROL BITS WEREN'T MASKED (IF ANY)
432
INITIALIZE SS DELAY CYCLE COUNTER (REG X)
434
436
G
482
N
HAS PH0 SS BIN BEEN DECR. TO ZERO?
438
446
440
Y
442
TURN ON PH0 TRIAC DRIVER
444
448
N
HAS PH1 SS BIN BEEN DECR. TO ZERO?
456
450
Y
452
TURN ON PH1 TRIAC DRIVER
454
H

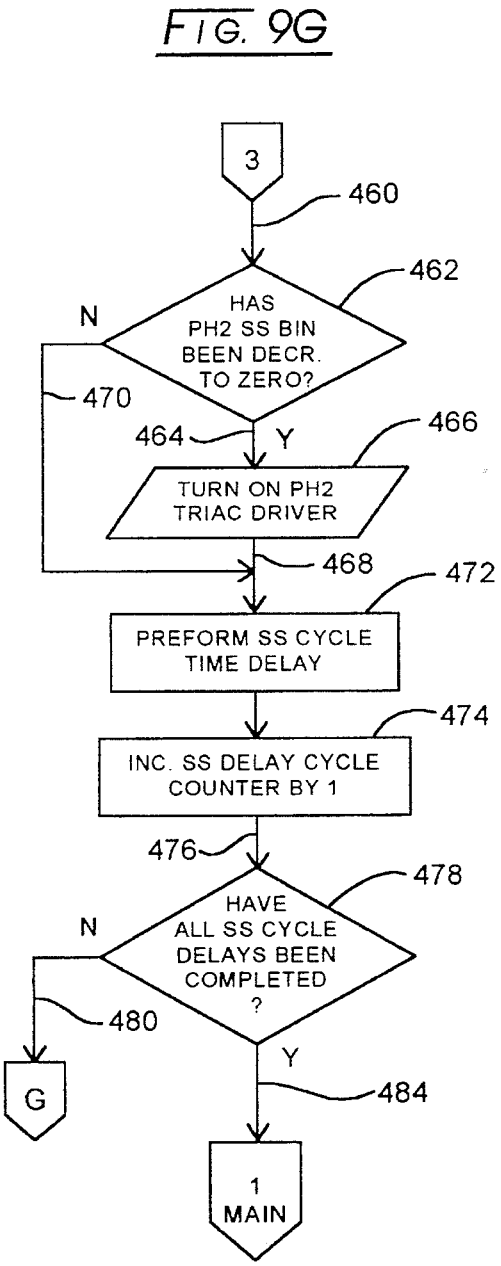
FIG. 9G
3
460
462
N
HAS PH2 SS BIN BEEN DECR. TO ZERO?
470
464
Y
466
TURN ON PH2 TRIAC DRIVER
468
472
PREFORM SS CYCLE TIME DELAY
474
INC. SS DELAY CYCLE COUNTER BY 1
476
478
N
HAVE ALL SS CYCLE DELAYS BEEN COMPLETED ?
480
G
Y
484
1
MAIN

CONSERVATION TRAFFIC CONTROL LOAD SWITCH

BACKGROUND OF THE INVENTION

Automotive and pedestrian traffic is controlled at street intersections by traffic signals which function as visual cuing devices. While these devices vary with the perceived needs of a given intersection, essentially all provide red, green, and yellow signals to achieve an ordered use of an intersection. These basic signals may be implemented with turning arrows, pedestrian walking controls, and the like. When installed in metropolitan areas, each signal head of the traffic signal may be switched in networking fashion from a computerized traffic control system. Generally, such networking systems as well as in situ computer based controls provide switching outputs to replaceable solid-state load switches which are removably installed in controller boxes usually mounted at a given corner of an intersection. The load switches conventionally switch power on and off to a given lamp or lamps through the utilization of a gatable triac in conjunction with an opto-isolated gating component.

Traffic signals and their associated controls have been somewhat standardized by governmental regulation and industry standards. Such regulations and standards set forth physical parameters, electrical parameters, and those related to requisite lamp output or luminance so as to afford drivers and pedestrians consistent and safe visual cuing. In this regard, for example, NEMA Standard 5-18-1983 specifies the physical characteristics, general electric characteristics, and test procedures for a three circuit solid-state load switch. Thus, while improvements may be contemplated by investigators in the traffic control field, such improvements generally must accommodate these preset standards. In particular, any improvements contemplated may not compromise any of the safety standardized aspects of traffic control. For example, circuitry improving the efficiency of the cuing systems must not interfere with what otherwise is normal operation, i.e. it must be entirely "failsafe". In this regard, where add-on circuitry is employed, should it fail, then the normal traffic control input must not be compromised, the traffic signal performing in its accepted general fashion in the event of a drop-out of subsidiary components.

As may be expected, the cost of providing, as well as maintaining traffic control networks is substantial. A contemplation of the number of incandescent light bulbs, load switches, and the like for each intersection, and the number of intersections in a given metropolitan area demonstrates a very substantial governmental outlay to this one aspect of traffic control. In addition to the substantial costs of initial installation, maintenance considerations of the control network represent a substantial portion of the given governmental traffic control budget. For example, for the purposes of safety, the bulbs within every traffic signal of a given metropolitan area generally are changed on a regular preventive maintenance schedule, for example every six months. The procedure for bulb replacement itself is problematic in terms of the safety of working personnel. Personnel have been struck by moving vehicles during this procedure. Notwithstanding the safety hazards associated with this, the cost of electrical power for operating a traffic control network is quite substantial. To lessen end cost, some investigators have looked to the provision of small load regulators formed, for example, as socket insert carrying triacs, which drop the applied current and voltage to a given lamp to thus conserve power while still maintaining luminance within requisite standards. These approaches have failed, however, because the inserts position the bulbs out of their optimal focal point position with respect to an associated covering traffic signal lens. Additionally, the devices are in line and thus detract from the operational security of the control system. In particular, such devices have been shown to affect the bulb failure detection components of traffic control systems, shutting down the sequencing operation of associated traffic lights.

SUMMARY

The present invention is addressed to a load switch, conservation circuit, and method for conserving the electrical power consumption and life span of lamps employed within traffic signals. These conservation features are achieved with a failsafe approach wherein the standard lamp illuminating function of traffic control is not compromised upon a failure of conservation based components. With the occasion of any conservation component failure, the conservation system, in effect, becomes passive as the traffic system continues to function normally.

In one aspect, design for conserving the life span of the lamps employed with traffic signals, a logic control monitoring network is provided which is responsive to an a.c. line source application to a traffic signal lamp to generate the lamp on condition. At the initiation of this lamp on condition, a processor responds to provide a soft start form of turn on for the lamp being energized for a predetermined relatively smaller number of a.c. line source cycles. The soft start is implemented by a solidstate shunting of a conventional optoisolated triac driver for an interval commencing, for example, with the start of a half cycle of the a.c. line source. The interval of shunting for this soft start approach is precomputed and a value therefor is retained in a memory contained look-up table, a value being provided for each of a sequence of true RMS line source voltage values.

In addition to monitoring for traffic controlling logic control conditions, the conservation approach of the invention also incorporates a solid-state monitor network which monitors and derives a cycle state signal corresponding with the instantaneous wave shape defining amplitude of each half cycle. This provides information for controlling the processor of the conservation system such that the commencement of each half cycle can be determined. Subsequent to the completion of soft start control, the conservation approach of the invention then turns to a voltage regulation mode which regulates the voltage applied to any lamp during traffic logic control illumination intervals such that the lamps are energized at an acceptable but lowered RMS voltage to conserve both energy and lamp life spans. The same shunting circuitry is employed for this purpose and, as before, in a preferred embodiment, a separate regulating voltage regulation look-up table is retained in processor memory for carrying out this function with respect to each of a sequence of a.c. line source voltage levels. Thus, in addition to the cycle state monitoring and logic control monitoring, the system also includes a voltage level monitor network for deriving information as to the voltage level of the a.c. line source. An important aspect of the invention resides in the technique wherein regulated processor employing voltages are superposed with the control d.c. source normally employed in carrying out traffic control logic. This, in particular, permits continued operation of the traffic system with any form of failure of the conservation based components.

The invention, accordingly, comprises the apparatus and method possessing the construction, combination of elements, steps, and arrangements of parts which are exemplified in the following detailed disclosure.

For a fuller understanding of the nature and objects of the invention, reference should be had to the following detailed description taken in connection with the accompanying drawings.

BRIEF DESCRIPTION OF THE DRAWINGS

FIGS. 9A–9G combine as represented thereon to provide a flow chart illustrating a control program employed with the processor function of the invention.

DETAILED DESCRIPTION OF THE INVENTION

Figure 1:
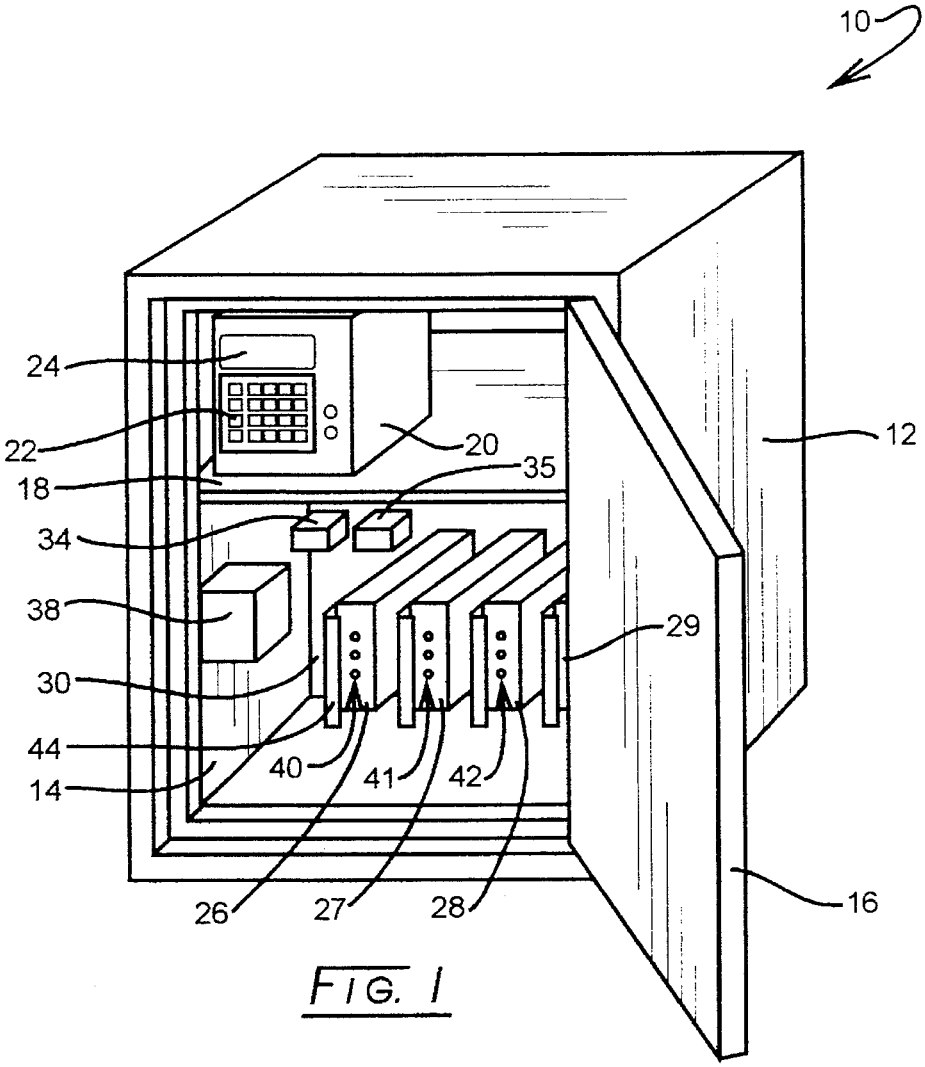
FIG. 1 is a perspective schematic view of a traffic control cabinet incorporating conventionally encountered equipment including load switches.

The load switch energy and lamp conservation features of the present invention achieve their conservation purpose while fully adhering to the somewhat rigid specifications and requirement of government and industry standards. Thus, the circuit of the invention is one which must be employed with standardized facilities including the ubiquitous traffic control box located at one comer of an intersection, as well as in conjunction with both in situ or localized computer controls for a given intersection and network controls employed in a somewhat metropolitan based environment. Thus, the salient standardized features of these traffic control systems initially are described, whereupon, the discourse turns to improvements of the invention as they relate to such standard components. Referring to FIG. 1, a traffic control cabinet or box may be employed for in situ intersection controls represented generally at 10. The cabinet 10 is of rectangular overall configuration with an enclosing body structure 12 defining a weather protected internal cavity 14 which is secured by a forward door 16. Within the cavity 14, a shelf 18 supports an in situ controlling computer 20 into which traffic control logic parameters may be inserted via a keypad 22 by service personnel. In the course of such manipulation of the keypad 22, an LCD readout or the equivalent is provided as represented at 24. Typically, a variety of additional visual indicators are provided with these devices which function to develop on and off logic control conditions for each lamp within each signal head or face of a traffic light. Additionally, the devices will provide controls to the lamps associated with pedestrian control lamps. The noted outputs of computer 20 are directed, inter alia, to a sequence of rectangularly shaped load switches, four of which are shown at 26–29. Each of these load switches 26–29 includes a male connector arrangement which plugs into a corresponding receiver board 30 at the back of cabinet 10. That board is seen additionally to support such items as relays 34 and 35 as well as transforming units, one of which is seen at 38. When the load switches 26–29 are mounted as shown, service personnel are presented three diagnostic LEDs as represented generally at 40–42 in the case of respective load switches 26–28.

Figure 2:
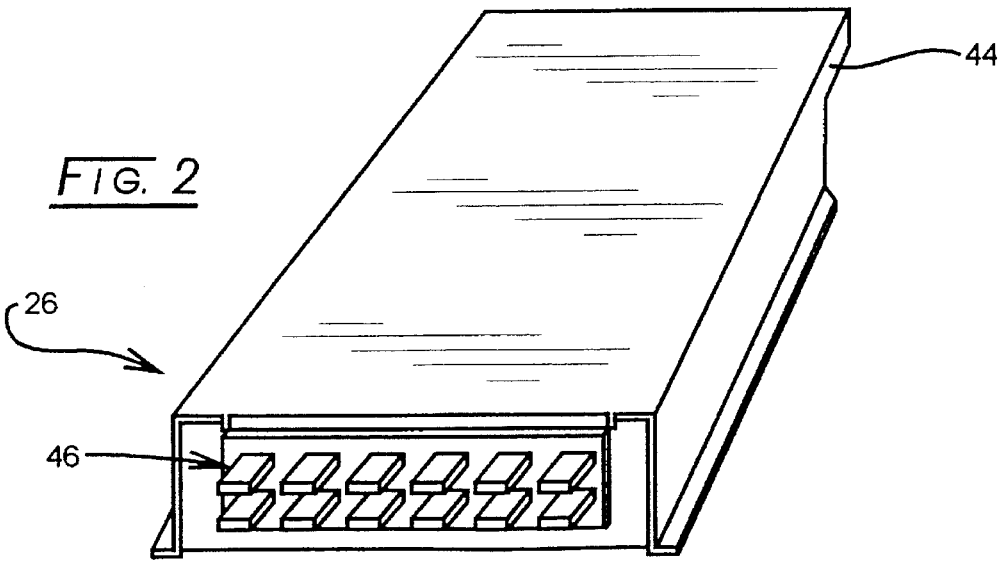
FIG. 2 is a-perspective view of a load switch employed in the cabinet of FIG. 1.

Looking to FIG. 2, load switch 26 is represented in more detail. The outward face containing the LED array 40 (not shown) is rearwardly oriented in the figure, however, a hand grippable portion 44 is revealed adjacent such face. Forwardly in the figure is a socket represented generally at 46. This socket is required to be a Cinch-Jones socket type S-2412SB or the equivalent in the earlier-noted NEMA standard 5-18-1983. Load switches as at 26 will exhibit overall dimensions not exceeding 8.5 inches from the surface of the connector 46 to the front of the unit including the handle or gripping device 44. The switch is no more than 1.75 inches in width and no more than 4.2 inches in height. In general, the three LED indicator arrays as at 40–42 will be designated, respectively, as circuit A at the top, circuit B in the middle, and circuit C at the bottom. These circuits, respectively, represent red or "don't walk," yellow for "caution" and green or "walk." Used diagnostically, service personnel may observe their outputs to determine the general location of defects or faults.

Socket 46 is seen to be comprised of two arrays of six male pins. One of those arrays is assigned: chassis ground, logic ground, a input, b input, c input, and no connection. The opposite array is assigned 120 v a.c., a output, b output, c output, ±24 v d.c. and a.c. common. Of the above assignments, logic ground is only for special function use and is not employed for normal switching circuit currents. In general, the load switch is required to turn on within 5 degrees of the zero voltage point of the a.c. current sinusoid applied from the a.c. source, as well as turn on within one cycle following the application of the logic control on signal. The load switch is required to perform all of its functions when supplied from at 24±2 volt d.c. source. All inputs to the device are negative true logic which is referred to the common of the 24 volt supply and which is characterized by the following:

(a) The transition zone of the input circuitry from the conductive state to the non-conductive state and vice versa occurs between 6 and 16 volts.

(b) A voltage between 0 and 6 volts shall cause the output device to conduct.

(c) A voltage greater than 16 volts causes the output device not to conduct.

In the absence of an input signal, the voltage at the input is required to rise to the level of the ±24 v.d.c. supply or control d.c. source when the input is connected to the supply through an external 10K ohm resistor. The load switch is required not to draw more than 20 milliamperes from a ±26 v.d.c. supply unless more than one circuit is energized in which case it is not to draw more than 20 milliamperes times the number of circuits energized. Additionally, each input circuit of the load switch is required to have reverse polarity protection. In general, the output current through the load switch when the load switch is in the off state is not to exceed 20 milliamperes peak at 135 v. a.c. Further, each switching circuit is required to have a minimum rating of 10 amperes RMS for either tungsten lamp loads or power factor corrected gas tubing transformer loads (power factor greater than 0.8) over a voltage range of 95 to 130 volts at 60 Hz. Each load switch circuit, A-C, is to be designed to switch a 1200 watt tungsten lamp load operating from 120 v. a.c. source for a minimum of ten million operations as well as each shall be capable of withstanding a one second surge current of 40 amperes RMS at 60 Hz.

Figure 3:
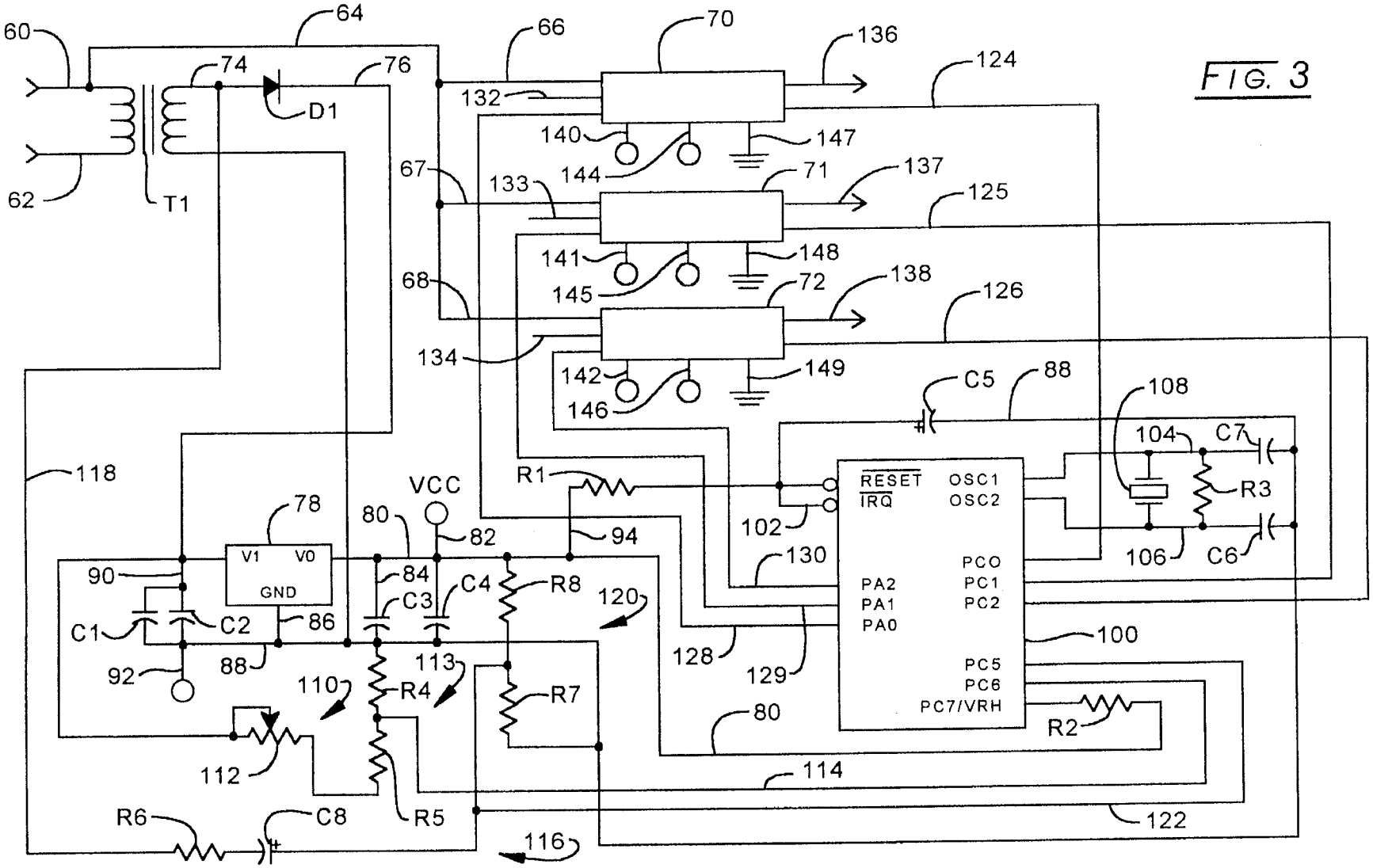
FIG. 3 is an electrical schematic circuit showing certain of the features incorporated in a load switch configured according to the invention.

Now turning to FIG. 3, general electronic features which are added to the standard load switch and cooperate with the three circuits, A, B, and C, are revealed. These circuits additionally are described, respectively, as phases 0, 1, and 2. In FIG. 3, the a.c. source, i.e. 120 v. a.c. is tapped as represented at 60 as well as the a.c. common shown at 62. These inputs are directed to the primary side of a transformer T1, whereupon they are stepped down at the secondary side thereof. The a.c. source tap 60 additionally is directed as represented by line 64 in conjunction with lines 66–68 to the phase 0, 1, and 2 circuits represented, respectively, at 70–72.

Returning to transformer T1, line 74 extending from one end of the secondary of the transformer is seen to contain a half wave rectifying diode D1 and extending to line 76 which, inter alia, is directed to the input of a voltage regulator 78. Regulator 78 may be provided, for example, as a type MC7805 three-terminal positive voltage regulator marketed by Motorola, Inc. The output of regulator 78 at line 80 provides a VCC output as represented at line 82. A common ground is provided between the input and line 76 and output line 80 of the device as represented at lines 84, 86, 88, and 90. Capacitors C1–C4 are incorporated with the regulator 78 for filtering and improved transient response. Note that a ground value is established with the regulator as represented at line 92. This ground as well as VCC is routed to and is seen to reappear in the three circuits 70–72.

Regulated output line 80 is seen to extend to line 94 and resistor R1 to the $\overline{\text{RESET}}$ terminal of a type HC705P9HCMOS microcontroller unit 100 marketed by Motorola, Inc. Unit or processor 100 is a high-density complementary metal-oxide semi-conductor microcontroller which incorporates such features as a type M68HC05 central processor unit (CPU) memory-mapped input/output (I/O) registers; two 112 bytes of user ROM including 16 user vector locations; 128 bytes of static RAM (SRAM); 20 bi-directional I/O pins; a synchronous serial I/O port; a 16-bit capture/compare timer; a self-check mode; a four-channel eight-bit a/d converter; and power saving STOP, WAIT, and Data Retention Modes. Employed with the present device 100 is the mask option identified as "computer operating properly" (COP) watchdog timer. This feature enhances the necessary reliability of the instant load switch modification. In this regard, the COP feature contains a COP timer that automatically times out if not cleared within a specific time by a program sequence. This system is used to detect software errors; and when a COP timer times out, a reset is generated. Reset on power-up is provided in conjunction with line 94 and resistor R1 which leads to the $\overline{\text{RESET}}$ terminal. Resistor R1 performs in conjunction with capacitor C5, in turn, coupled by line 88 to ground. Thus, on power-up, a transition occurs to carry out an automatic reset. Line 102, extending to the $\overline{\text{IRQ}}$ terminal from line 94 also asserts this signal as an external interrupt request.

Line 80 at the output of regulator 78 also extends through resistor R2 to provide a 5 v reference to terminal PC7 of the analog-to-digital (aid) converter function of device 100. Thus configured, the input provides a VRH positive reference. When this aid function is enabled, ports PC3–PC6 become analog inputs 0–3 (only ports PC5 and PC6 are shown).

Terminals OSC1 and OSC2 are the control connections for the on-chip oscillator. In the present arrangement, these ports are coupled to a typical crystal oscillator circuit incorporated between lines 106 and including a crystal 108 performing in combination with resistor R3 and capacitors C6 and C7.

The microcontroller or processor unit 100 receives two monitored inputs at its PC5 and PC6 inputs which are employed in developing soft start and voltage regulation information. In this regard, a voltage level monitor network represented generally at 110 derives a scaled voltage level value corresponding essentially with the RMS voltage level of the a.c. line source provided to the control system. This is the source which drives the traffic signal incandescent lamps. Network 110 is seen to receive the single cycle rectified output of the secondary of transformer T1 via line 76 which is introduced through a potentiometer 112 to a voltage divider represented in general at 113 and comprised of resistors R4 and R5. Divider network 113 is tapped between those resistors by line 114 which is directed to terminal PC6 of processor 100. This voltage level data will be seen to be employed in conjunction with regulator and soft start look-up tables retained in processor memory.

The second input presented for digitization by processor 100 is derived from a cycle state monitor network represented generally at 116. Network 116 derives a cycle state signal corresponding to the instantaneous wave shape defining amplitude of each half cycle of the line source. For convenience, the negative-to-positive and positive-to-negative transitions or zero crossings of the sinusoid-like signal are located by processor 100. To derive this signal, the secondary side of transformer T1 at line 74 is tapped at line 118. The attenuated a.c. signal at line 118 is directed through attenuating resistor R6 and coupling capacitor C8 to a divider network represented at 120. Network 120 is comprised of resistors R7 and R8 which, in turn, are coupled across the output lines 80 and 88 of regulator 78. With this arrangement, one-half of the regulator output voltage, i.e. 2.5 volts, is superimposed upon the signal introduced through capacitor C8 and the summed instantaneous voltage amplitude values are presented from line 122 to the PC5 terminal of processor 100. In its general convening operation, the analog to digital function of processor 100 then will observe a zero crossing at the mid-point of its scale, i.e. its binary value 127 of a range of 254. This facilitates the identification of a positive-to-negative or negative-to-positive cycle transition. Of course, other identifiers of positions within the line sinusoid will occur to those art-skilled, however, a zero crossing, as noted, is convenient.

For the three phase (0, 1, and 2) or three drive circuit version of a load switch according to the invention, processor 100 also receives an on logic control condition at its PC0–PC2 input ports, respectively from phase circuits 70–72. These inputs are provided, respectively, from lines 124–126. The logic control condition is the low or ground true input asserted from the local traffic control computer 20, FIG. 1, or through the networking system of a traffic control scheme. The commencement of this signal as well as its end is detected and a corresponding logic output condition is presented at lines 124–126. Thus, the processor 100 will have information corresponding to the zero crossing of a given sinusoid of line input; a value corresponding with the RMS voltage level of the line source; and the instantaneous condition of a traffic signal incandescent lamp as to whether it is on or off. Processor 100, then carries out soft start for a predetermined number of sinusoid cycles, for example eight cycles, whereupon it then follows with a regulation of a.c. line input, generally at a level lower than the source voltage level. Both of these corrections are provided by asserting a delay in switching on a.c. power for a given portion of each a.c. cycle. For each level of source voltage, a value for this soft start and then regulation delay interval is retained in memory look-up tables. Of importance, however, this soft start and regulation improvement is carried out in a manner wherein for any component or failure of processor 100, the traffic system will continue to operate with its original lamp control components and without interruption. Thus, a failsafe arrangement is achieved which is desirably passive in nature, having no adverse impact upon the load switch function. In general, the outputs of processor 100 asserting this delay are logic low true or ground true conditions which are presented from terminals PA0–PA2 along respective lines 128–130 to circuits 70–72. When observed at an oscillotrace, the cycle modulation conditions at port A output lines 128–130 appear as a rectangle wave which is pulse width modulated. Circuits 70–72 also are seen to receive the logic control conditions of the computer 20 or network control system as represented at respective lines 132134 and provide corrected load drive outputs as represented at respective lines 136–138. Additionally, it may be noted that the circuits 70–72 are coupled with regulator 78 output VCC from line 82 as represented at respective lines 140-142, and, additionally, are associated with corresponding regulator ground as represented at line 92 at respective lines 144–146. Ground connections also are provided at common ground lines 147–149 as required by industry standards and regulations. With the arrangement of circuits 70–72, there evolves a unique combination of the 24 v based traffic control voltage as discussed above with the outputs of regulator 78.

Figure 4:
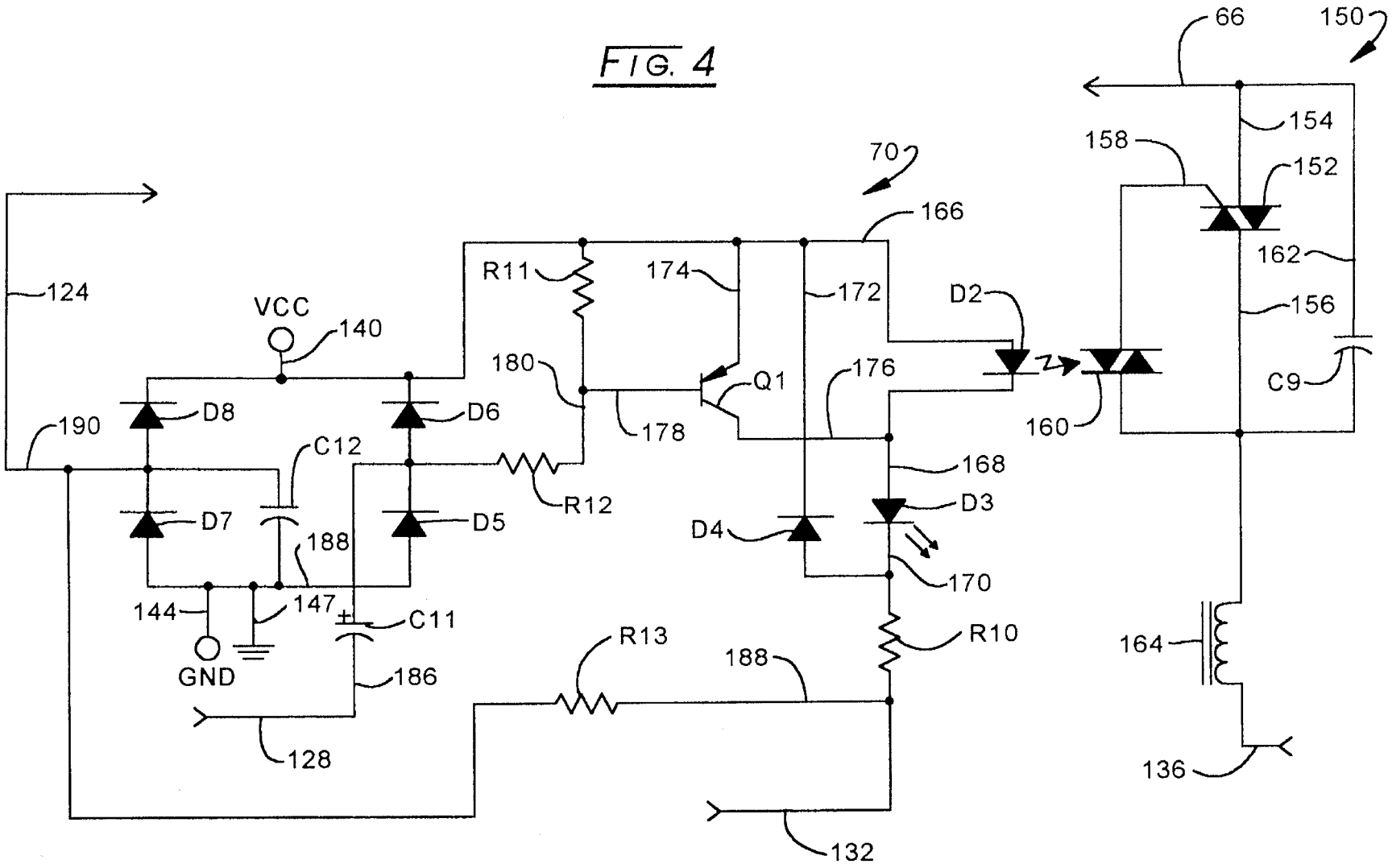
FIG. 4 is an electrical schematic drawing showing certain circuit components employed with generally depicted circuits shown in FIG. 3.

Referring to FIG. 4, circuit 70, identical to circuits 71 and 72, is shown in enhanced detail. In the circuit, the inputs and outputs as well as VCC and ground connections which have been identified in FIG. 3 again are represented. In this regard, the a.c. line source is seen introduced again from line, now arrow 66, to a triac load driving network 150, the principal component of which is a triac or switching thyristor 152, one side of which is coupled via line 154, while the opposite side thereof is coupled via line 156 for transferring current to a lamp load as represented at output arrow 136. In general, the thyristor is a bistable semiconductor device comprising three or more junctions that can be switched from the off state to the on state or vice versa. The device is gated into conduction from gate line 158 which, in turn, is coupled to line 156 through a silicon bilateral switch 160. Gating switch 160 performs in conjunction with a gallium-arsenide infrared emitting diode D2. DiMe D2 and device 160 generally are sold as singular component, for example, the six-pin DIP optoisolator triac driver marketed as type MCP3020 by Motorola, Inc. Because of the switching frequencies involved with the system, a filter capacitor C9 is coupled about device 152 by line 162 and, additionally, an inductor 164 within line 156 contributes to filtering. With the arrangement shown, when bilateral switch 160 gates triac 152 into conduction, a.c. line power is switched to the load as represented at arrow 136 and this normally occurs in response to an applied logic control condition defining the interval of illumination of a traffic lamp. When those ground or low logic true conditions are applied at arrow 132, the specified 24 v .d.c. or control d.c. source is asserted at the anode of emitting diode D2 from line 166. The cathode of emitting diode D2 is coupled via line 168 to the anode of a light emitting diode D3 which is energized to provide the diagnostics described earlier in conjunction with diode arrays 40–42 (FIG. 1). The cathode of LED D3 is coupled via line 170 and a current limiting resistor RI0 to the control input represented at arrow 132. With the arrangement, LED D3 and emitting diode D2 are energized simultaneously with the application of the logic control condition. In keeping with the earlier-noted regulations and standards, a diode D4 is coupled within line 172 between lines 170 and 166 to provide reverse polarity protection.

All of the components of the circuit 70 thus far described form part of the normally functioning load switch and are standardized. The components constituting the remainder of circuit 70 cooperate with the circuitry of FIG. 3 to achieve a soft start and subsequent regulated power supply input without imposition upon standard components and systems.

To carry out soft start and subsequent power supply regulation, the energization of emitting diode D2 is delayed at the commencement of each half cycle of the a.c. source presented from line 66. This is carried out by a shunt switch which must be active or turned on in order to carry out the noted shunting and which remains passively off under all other conditions. For the present embodiment, this switch is implemented as a PNP transistor Q1. The emitter of transistor Q1 is coupled via line 174 to line 166 which, in turn, carded the earlier-described ±24 v d.c. of the system as well as VCC as seen at line 140 in this figure. The collector of transistor Q1 is coupled via 176 to line 168, thus the emitter and collector connection of transistor Q1 is configured as a shunt about emitting diode D2. The base of transistor Q1 is coupled via line 178 to line 180. Line 180, in turn, extends through resistor R11 to line 166, and through resistor R12 to a coupling capacitor C11. The opposite side of capacitor C11 at line 186 is coupled to arrow 128 which is a low true cycle modulation on condition presented from processor 100. It may be observed that while the noted ±24 v .d.c. and VCC at line 140 are superposed, the corresponding grounds also are superposed as represented at line 188 which extends through level adjusting diode D5, thence to a connection with line 180 and, finally, through level adjusting diode D6 to line 166. With the arrangement shown, line 186 is drawn to a logic low true condition for an interval commencing with each cycle cross-over of the a.c. line source. This draws shunting switch or PNP transistor Q1 into conduction to assert a shunt across emitting diode D2. The interval during which this partial cycle shunt is imposed is selected as being a relatively large interval of a given half cycle for soft start purposes and then for a relatively short interval of each half cycle to achieve regulation, for example, at 100 v a.c. (RMS). Where any component or microprocessor failure occurs in this added conservation circuit, then transistor Q1 becomes domant and emitting diode D2 performs in conjunction with control d.c. source or 24 v d,c. in its normal manner upon the appropriate assertion of ground at arrow 132. In consequence, the traffic control system simply reverts to its otherwise normal operation but without conservation features.

The particular interval of energization of transistor Q1 and holding off of emitting diode D2 depends upon the RMS voltage level of the a.c. line source. In this regard, the interval will be longer for higher voltage levels of the a.c. source and lower for lower voltage levels. To facilitate and substantially simplify as well as standardize the extent of shunting interval, these interval values are predetermined and placed in look-up tables for each of a sequence of normally encountered a.c. line voltages.

The monitoring of the logic control conditions provided at arrow 132 and present at line 170 is carded out by a network including line 188 and current limiting resistor R13. Line 188 extends to line 190 which, in turn, provides the output represented at arrow 124. Line 190 is seen coupled between lines 188 and 166 at a location intermediate level adjusting diodes D7 and D8. The line extends through capacitor C12 to line 188. With the arrangement shown, a transition at arrow 132 to a logic low state will be witnessed as a corresponding transition at arrow or line 124. As described in connection with FIG. 3, line 124 extends to the PC0 input of processor 100.

As noted earlier, the interval extent commencing with a given cycle cross-over during which emitting diode D2 is held off in the presence of an on logic control condition is determined through the utilization of memory contained look-up tables. Two such tables are employed in a preferred embodiment, the initial one being a soft start look-up table which, for a sequence of voltages, for example, 100 v–145 v, provides a binary value representing an initial and largest interval. For each cycle, this value is decremented. In a soft start mode, the decrementation takes place for only a predetermined number of cycles, for example, eight cycles. Thus, the consistent knowledge of true RMS voltage value of the line source is not particularly as important for soft start purposes as it is for regulation purposes. This leads to the convenience of utilizing two separate tabulations for the modes of operation. Table I below shows the memory retained values utilized for determining soft start shunting intervals for the above-noted sequence of voltages. These voltage values are listed in a vertical column commencing with 100 v. Next adjacent to those voltage values are the values of binary word markers or indexes, for example, commencing with 170 and ending with the value 250. The accessing number increases, for the most part, by a value of 10 for voltages extending between 100 v and 106 v. Thus, in the table, the soft start interval relative value is 200; then for the value 171 the soft start interval value again is 200, and for the indexing value 172, the interval defining value is 189. These initial values are decremented by some predetermined number, for example 10 with each cycle, and the soft start procedure continues with lessening shunt intervals until such time as the level for regulation at the true RMS line voltage is reached. At that time, the regulator look up table is accessed.

TABLE I

| Instant Delay Value | | | | | | | | | | Index | A.C. RMS Source Voltage |
|---|---|---|---|---|---|---|---|---|---|---|---|
| 0 | 59 | 75 | 86 | 94 | 82 | 88 | 94 | 99 | 104 | 170 | 100 v |
| 114 | 118 | 122 | 126 | 129 | 132 | 136 | 139 | 142 | 145 | 180 | 106 v |
| 148 | 152 | 155 | 158 | 161 | 164 | 167 | 169 | 171 | 173 | 190 | 112 v |
| 175 | 177 | 178 | 180 | 182 | 184 | 186 | 188 | 190 | 192 | 200 | 118 v |
| 194 | 196 | 198 | 200 | 202 | 204 | 206 | 208 | 210 | 212 | 210 | 124 v |
| 214 | 216 | 218 | 220 | 222 | 224 | 226 | 228 | 230 | 232 | 220 | 130 v |
| 234 | 236 | 238 | 240 | 241 | 243 | 245 | 248 | 250 | 252 | 230 | 135 v |
| 254 | 254 | 254 | 254 | 254 | 254 | 254 | 254 | 254 | 254 | 240 | 141 v |
| 254 | 254 | 254 | 254 | 254 | 255 | | | | | 250 | 145 v |

Figure 5:
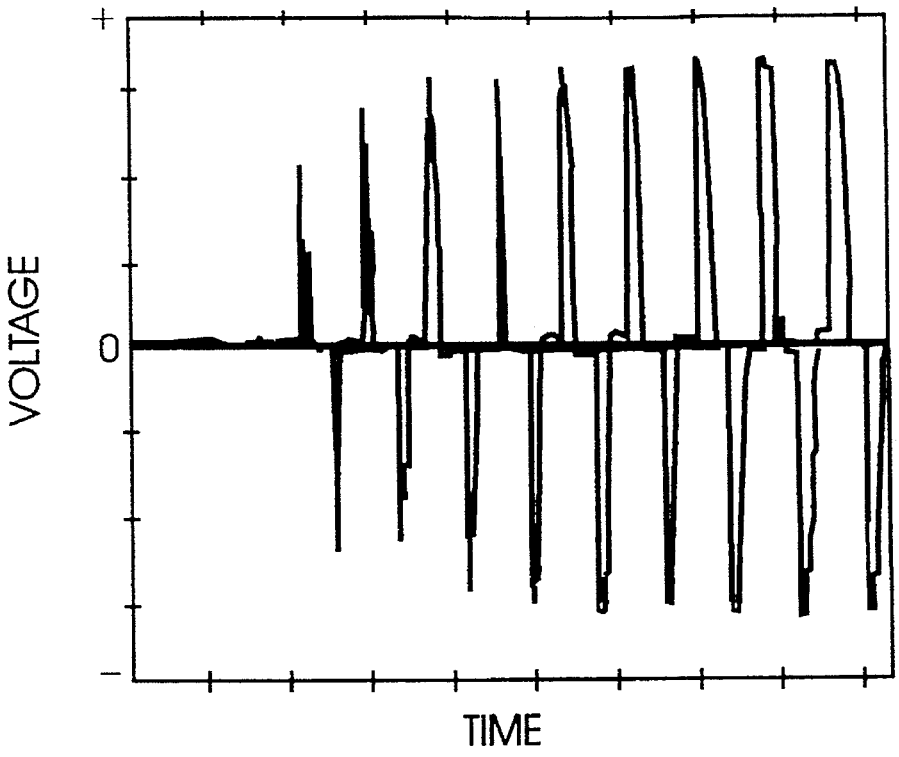
FIG. 5 is a representation of an oscillotrace showing the results of a soft start in accordance with the invention.

Looking momentarily to FIG. 5, a oscillotrace is represented showing 10 cycles of a relatively rapid ramp-up of an a.c. line source voltage of 120 v a.c. during a soft start procedure. As is apparent, the shunt across emitting diode D2 is removed much later in each of the positive going and negative going halves of a cycle at the commencement of soft start control and the shunt interval for each half cycle is rapidly decreased. While only a short interval is required for start-up, incandescent bulb lamp light spans are increased substantially with no visually perceptible alteration of the visual cuing function of a traffic signal.

Once soft start procedures are concluded, the system turns to a regulation mode where applied a.c. line current is attenuated again by select shunting of emitting diode D2 to a targeted desired voltage which remains within published standards and regulations to achieve proper visual cuing, but while saving energy as well as bulb life. Generally, a predetermined target or energy conserving optimum voltage value for carrying out the energization of the incandescent lamp is about 100 v. Table II below which is seen to be quite similar to Table I shows the voltage range of 100 v adjacent to which a word marker or indexing number is provided, each identifying a row of values representing the shunting interval computed for a given a.c. source voltage level.

TABLE II

| Instant Delay Value | | | | | | | | | | Index | A.C. RMS Source Voltage |
|---|---|---|---|---|---|---|---|---|---|---|---|
| 200 | 200 | 189 | 182 | 177 | 171 | 167 | 164 | 160 | 157 | 170 | 100 v |
| 154 | 151 | 149 | 146 | 144 | 142 | 139 | 137 | 135 | 134 | 160 | 106 v |
| 132 | 130 | 129 | 127 | 126 | 124 | 122 | 121 | 120 | 119 | 190 | 112 v |
| 117 | 116 | 115 | 113 | 112 | 111 | 110 | 109 | 108 | 106 | 200 | 118 v |
| 105 | 104 | 103 | 102 | 102 | 100 | 100 | 98 | 98 | 97 | 210 | 124 v |
| 96 | 95 | 94 | 93 | 92 | 92 | 91 | 90 | 89 | 88 | 220 | 130 v |
| 88 | 87 | 86 | 85 | 85 | 84 | 83 | 83 | 82 | 81 | 230 | 130 v |
| 81 | 80 | 80 | 79 | 78 | 77 | 77 | 76 | 76 | 75 | 240 | 141 v |
| 74 | 74 | 74 | 73 | 73 | 73 | 73 | | | | 250 | 145 v |

Figure 6:
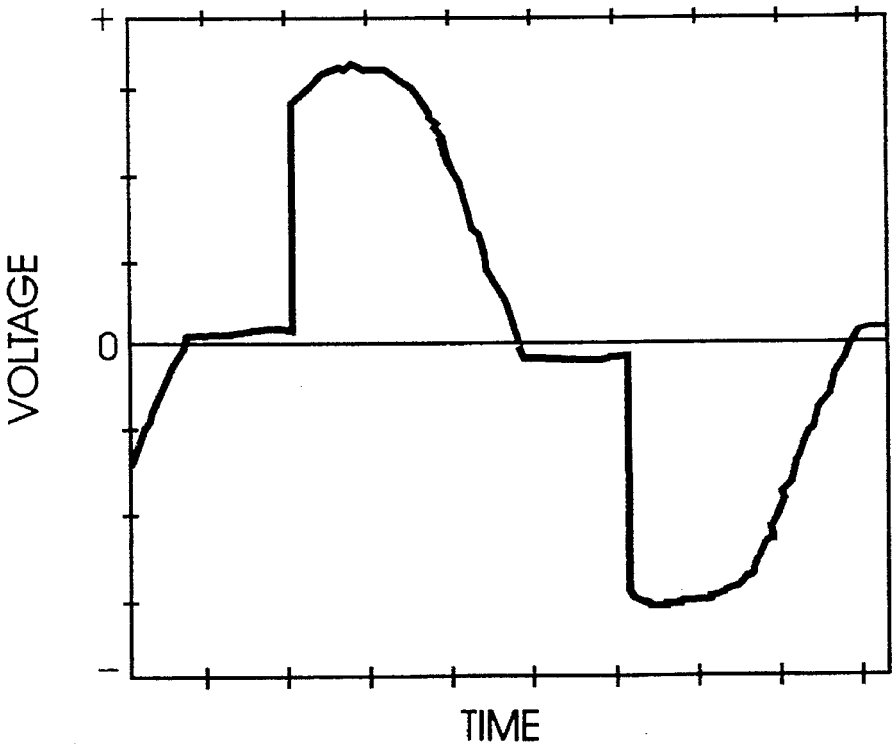
FIG. 6 is a representation of an oscillotrace showing the profile of a cycle of a.c. line source as regulated according to the invention with respect to an a.c. line voltage of 110 v a.c.
Figure 7:
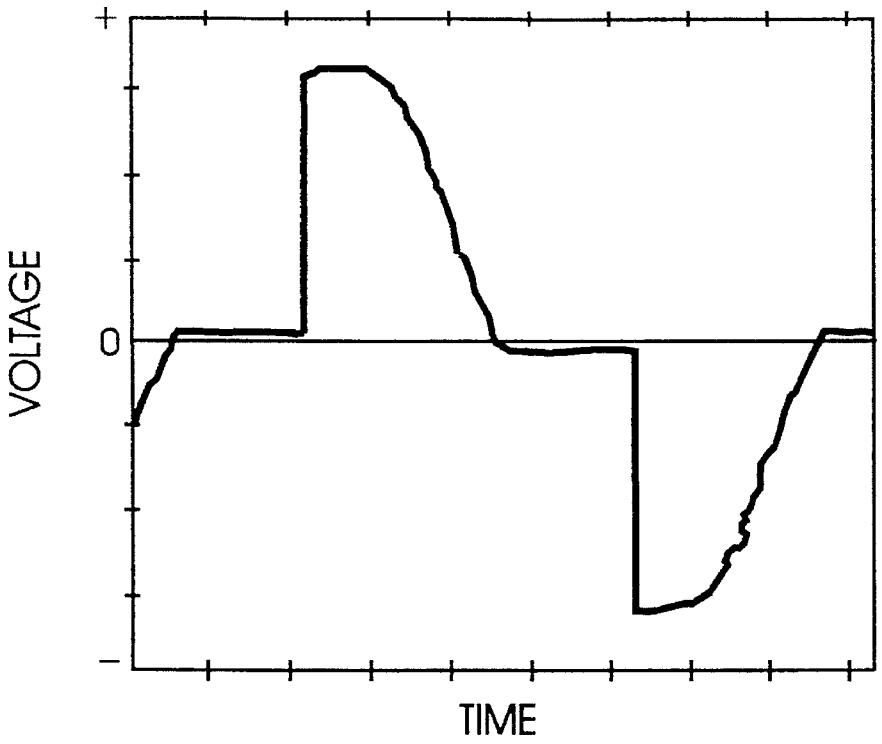
FIG. 7 is a representation of an oscillotrace showing the profile of a cycle of a.c. line source as regulated according to the invention with respect to an a.c. line voltage of 120 v a.c.
Figure 8:
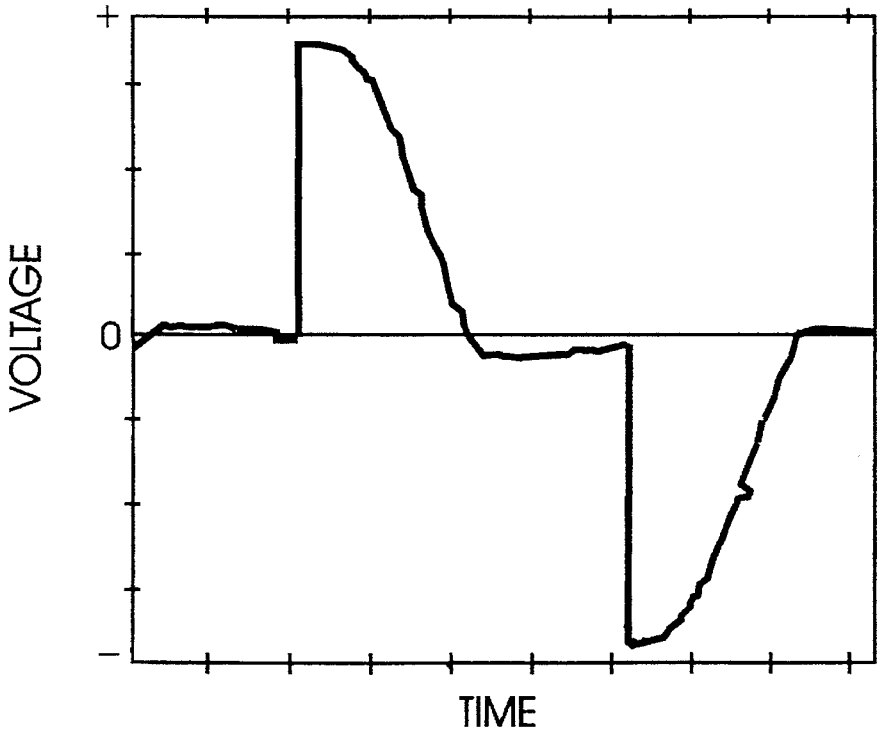
FIG. 8 is a representation of an oscillotrace showing the profile of a cycle of a.c. line source as regulated according to the invention with respect to an a.c. line voltage of 135 v a.c.

FIG. 6 depicts an oscillotrace showing the regulation of a cycle for an a.c. line source voltage of 110 v a.c. The oscillotrace represented in FIG. 7 shows regulation for a 120 v .a.c. line source; and FIG. 8 represents an oscillotrace showing regulation under a 135 v a.c. line source.

Referring to FIG. 9A, a flow chart is provided which generally describes the program under which processor 100 performs. The program commences at begin node 200 and then carries out initialization steps as represented at block 202. These initialization steps include the zeroing of the counter deriving the cycle modulation on condition or delay from cross-over. The soft start bins are zeroed. Port A, which is coupled to the noted lines 128–130 is turned off, and all ports are appropriately configured. Next, all old switch readings are reset and the analog-to-digital function at port C is set-up to carry out a read function. It may be recalled that the analog signals are read at ports PC5 and PC6. The program then continues as represented at line 204 and block 206 where the instantaneous wave shape defining amplitude of the a.c. line source is determined in conjunction with the cycle state monitor network 116 and the associated analog-to-digital converter function of processor 100. As represented at block 208, a determination is made as to whether the wave shape has reached a negative portion of the cycle. If not, the program loops as represented by line 210 extending to line 204. Where that negative component of the wave shape has been reached, then as represented at line 212 and block 214, the COP (computer operating properly) timer is reset and, as represented at block 216, the three phase inputs are read. It may be recalled that these inputs are developed from a logic control monitor network and the conditions are submitted to processor 100 from lines 124–126. Next, as represented at block 218, the phase inputs are inverted and saved, and, as represented at block 220, the power supply input is read at a voltage level monitor network 110. The program then proceeds to the query posed at block 222 determining whether the voltage level of the a.c. source or line voltage is less than the desired regulation level voltage as developed from Table II. In the event that the power supply is at a level below that regulation point, then as represented at line 224, the program returns to line 204, no regulation being carded out. Where the a.c. power level or line voltage is above the point of regulation, which may, for example, be 100 v a.c. (RMS), then as represented at line 226, the program continues as represented at node A.

Turning to FIG. 9B, node A reappears in conjunction with line 230 leading to the instructions at block 232. This block provides for the setting-up of the regulation and offset tables, including soft start tables, as well as the setting of the voltage regulator and soft start fields to zero. Next, as represented at block 234, a determination is made as to whether phase 0 was active, this phase, for example, being the red visual cuing illumination circuit. In the event that it was not active, then as represented at line 236 and block 238, the query is posed as to whether phase 0 is now active. In the event that it is, then as represented at line 240 and block 242, the soft start function is set for the number of delay cycles. As noted above, this will be a relatively short number, for example 8 to 10 cycles. Additionally, that number of cycles is stored in the phase 0 bin. The program then continues as represented at line 244. Where the inquiry at block 234 results in an affirmative determination, then as represented at line 246, the program proceeds to line 244. Similarly, where the inquiry at block 238 results in a negative determination, that phase 0 is not active at the present time, the same procedure follows as represented at lines 248 and 246 leading to line 244. Next, phase 1 is evaluated, that phase, for example, representing a yellow traffic viewing output. Block 260 of this phase evaluation queries as to whether phase 1 was active. In the event that it was not, then as represented at line 262 and block 264, a determination is made as to whether phase 1 now is active. In the event that it is, the commencement of an on logic control condition is present for soft start activity to be called for. Accordingly, with an affirmative determination with respect to the query at block 264, as represented at line 266 and block 268, the soft start is set for the number of delay cycles and that is stored in the phase 1 bin. The program then continues as represented at line 270. Where the inquiry at block 260 as to whether phase 1 was active results in an affirmative determination, then as represented at line 272, the program diverts to line 270. Similarly, where a negative determination is made with respect to the query at block 264, then as represented at lines 274 and 272, the program progresses to line 270 and the query posed at block 276. The query posed at block 276 as to whether phase 2, for example representing a green traffic cuing, was active. In the event that it was not, then as represented at line 278 and block 280, a determination is made as to whether phase 2 is now active. In the event that it is, then the program continues as represented at line 282 and connector 2B. Looking additionally to FIG. 9C, connector 2B reappears in conjunction with line 284 leading to the instructions at block 286. The latter block provides, as before, the setting of the soft start for the number of delay cycles and storing of such data in the phase 2 bin. Returning to FIG. 9B, where the query posed at block 276 results in an affirmative determination that phase 2 was active, then as represented at line 290, the program proceeds as represented at connector 2C. Connector 2C reappears in FIG. 9C in conjunction with line 292 extending to line 288. Thus, where phase 2 was active, then no soft start activity is called for. Where the query at block 280 of FIG. 9B results in a negative determination, then as represented at line 294, the program again proceeds as represented at connector 2C which, as noted, reappears in FIG. 9C in conjunction with lines 292 and 288.

Line 288 is seen directed to block 300 which calls for updating the status of each phase with respect to the current condition and immediate history of the logic control conditions for each phase. Next, as set forth at block 302, the port A outputs are set-up, a procedure which serves to activate all triac control bits. As represented at block 304, the query then is made as to whether the soft start for phase 0 is completed. In the event that it is not, then as represented at line 306 and block 308, the soft start bin count is decremented and the phase 0 triac control bit is turned off. The program then continues as represented at line 310. In the event of an affirmative determination with respect to the query at block 304, then, as represented at line 312, the program looks to the state of soft start in connection with the next phase. Accordingly, as represented at block 314, a query is made as to whether the soft start at phase 1 is completed. In the event that it is not, then as represented at line 316 and block 318, the soft start bin count is decremented and the phase 1 triac control bit is turned off. The program then continues as represented at line 320. Where the inquiry at block 314 results in an affirmative determination, then as represented at line 322, the program advances to line 320. Next, as represented at block 324, a query is made as to whether the soft start procedure is completed with respect to phase 2. In the event that it is not, then as represented by line 326 and connector 2E, the program continues as represented at line 330 and the same indicator to the instructions at block 332 which is seen in FIG. 9D. Referring additionally to that figure, block 322 is seen to carry out a decrementing of the soft start bin count for this phase and the control bit for phase 2 is turned off. The program then continues as represented at line 334. Where the inquiry posed at block 324 results in an affirmative determination, then as represented at line 336 and lead indicator 2D, the program extends to line 334 as shown in FIG. 9D in connection with the lead 2D and line 338. Line 334 extends to the instructions at block 336 which provide for dropping triac drive before a cycle end. This permits a clear definition of cycle cross over for the system. The program then continues as represented at line 340 and block 342 to look for a positive going zero cross over. In this regard, block 342 provides for reading in the sinusoid values and the query posed at block 344 determines from that data whether a zero cross over has occurred. In the event that it has not, then as represented at line 346, the program loops until the cross over is achieved.

The program then continues as represented at block 348 to carry out the Table II defined delays for regulation. These delay intervals will be shorter than those for soft start. Thus, where Table I soft start procedures are to be carried out, then the Table II regulation control bits are masked. Next, as represented at block 350, the program effects the turning on or assured turning on of those triacs of the three phases whose control bits were not masked. Then, as represented at block 352, the soft start delay cycle counter is initialized and the program proceeds as represented at line 354 and node E.

Figure 9E:
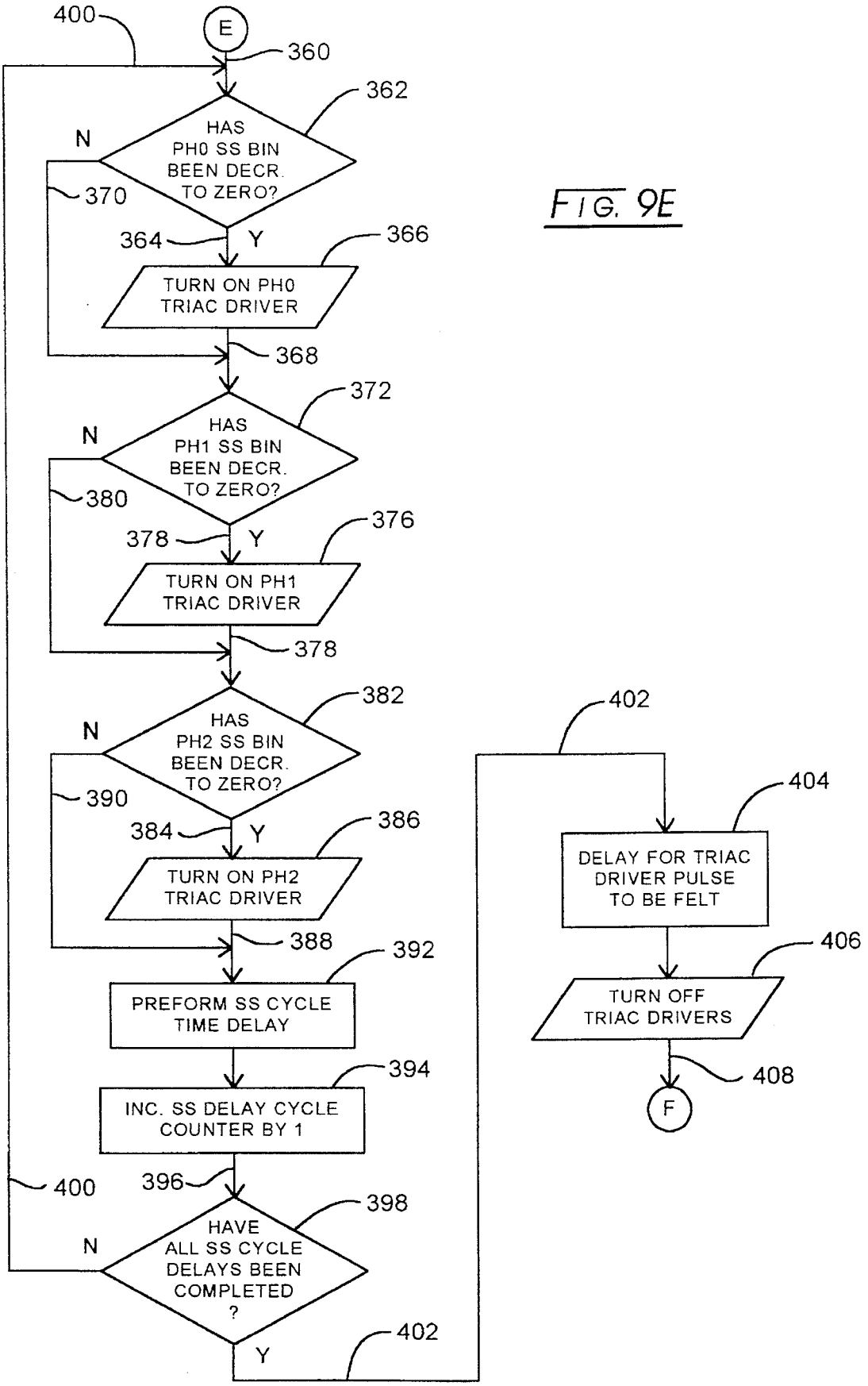

Referring to FIG. 9E, node E reappears in conjunction with line 360 which leads to a sequence of inquiries which determine whether soft start activity with its longer delay intervals has been concluded with respect to the positive going half cycle at hand. Block 362 poses the query as to whether the phase 0 soft start bin has been decremented to a zero value. Then as represented at line 364 and block 366, the phase 0 triac driver is turned on, a delay for regulation having already occurred. The program then continues as represented at line 368. In the event of a negative determination with respect to the query posed at block 362, then as represented at line 370, the program advances to line 368. Next, as represented at block 372, a query is posed as to whether the phase 1 soft start bin has been decremented to zero. In the event that it has, then as represented at line 374 and block 376, the phase 1 triac driver is turned on and the program proceeds as represented at line 378. Where a negative determination has been made with respect to the query at block 372, then as represented at line 380, the program progresses to line 378 and the inquiry at block 382. The latter inquiry determines whether the phase 2 soft start bin has been decremented to zero. In the event that it has, then as represented at line 384 and block 386, the phase 2 triac driver is turned on and the program proceeds as represented at line 388. However, where the query posed at block 382 results in a negative determination, then as represented at line 390, the program progresses to line 388 and the instructions at block 392 providing for the performance of the soft start cycle time delay. Such delay will, in effect, represent an extension of the delay which commence for voltage regulation to a soft start interval. The program then proceeds as represented at block 394 to increment the soft start delay cycle counter by 1 and, as represented at line 396 and block 398, a query is made as to whether all soft start cycle delays have been completed. Where that is not the case, then as represented at line 400, the program reverts to line 360 and the inquiry at block 362.

The program then continues as represented at line 402 and block 404 to carry out a delay for the triac driver function to be recognized by the monitors. Then, as represented at block 406, the triac drivers are turned off and the program proceeds as represented at line 408 and node F.

Referring to FIG. 9F, node F reappears in conjunction with line 420 as the system looks for the next zero crossing of the a.c. line as it progresses into a negative going half cycle. In this regard, as represented at block 422, the sinusold input values are read and, as represented at block 424, a query is made as to whether the next zero crossing has been determined to be present. In the event that it has not, then as represented at line 426, the program returns to line 420 and dwells until the cross-over is detected. In the event of an affirmative determination at block 424, then as represented at line 428 and block 430, the delay interval for voltage regulation is carried out in the same manner as described in conjunction with block 348 in FIG. 9D. Then, as represented at block 432, the triacs for those phases whose control bits were not masked for soft start are turned on and, as represented at block 434, the soft start delay cycle counter is initialized. The program then continues as represented at line 436 and block 438 to a determination as to whether the phase 0 soft start bin has been decremented to zero for this negative going half cycle. In the event that it has, then as represented at line 440 and block 442, the phase 0 triac driver is turned on and the program proceeds as represented at line 444. In the event of a negative determination with respect to the query posed at block 438, then as represented at line 446, the program proceeds to line 444 and the query posed at block 448. At the latter block, a determination is made as to whether the phase 1 soft start bin has been decremented to 0. In the event that it has, then as represented at line 450 and block 452, the phase 1 triac driver is turned on and the program proceeds as represented at block 454 and connector H. Where the query posed at block 448 results in a negative determination, then as represented at line 456, the program proceeds to line 454.

Referring to FIG. 9G, connector H reappears in conjunction with line 460 looking to the inquiry represented at block 462. At block 462, a determination is made as to whether the phase 2 soft start bin has been decremented to zero. In the event that it has, then as represented at line 464 and block 466, the phase 2 triac driver is turned on and the program proceeds as represented at line 468. Where the query posed at block 462 results in a negative determination, then as represented at line 470, the program proceeds to line 468 and the instructions at block 472. Block 472 provides for carrying out a soft start time delay for this negative going half cycle. Then, as represented at block 474, the soft start delay cycle counter is incremented by 1 and as represented at line 476 and block 478, inquiry is made as to whether all soft start cycle delays have been completed. In the event that they have not, then as represented at line 480 and connector G, the program returns to line 436 as shown in FIG. 9F where lead connector G reappears in conjunction with line 482. Where the query posed at block 478 results in an affirmative determination, then as represented at line 484 and lead block "1 MAIN", the program returns to line 212 as seen in FIG. 9A where lead block 1 MAIN is reproduced in conjunction with line 486 leading to line 212.

Since certain changes may be made to the above-identified apparatus and method without departing from the scope of the invention herein involved, it is intended that all matter contained in the description thereof or shown in the accompanying drawings shall be interpreted as illustrative and not in a limiting sense.

What is claimed:

1. In a lamp switching circuit of a variety having a switching thyristor responsive to an actuating input to supply current from an a.c. source to an incandescent lamp, said a.c. source exhibiting a given voltage level and positive and negative going half cycle characteristics, to an incandescent lamp, said actuating input being derived at a solid state bilateral switch, in turn, having an actuating component responsive to first and second logic control conditions to respectively effect derivation of said actuating input and removal of said actuating input, the conservation circuit comprising:

a solid state shunt switch coupled in shunting relationship across said actuating component, having an on condition applying a shunt across said actuation component removing said actuating input in response to a cycle modulation on condition and having an off condition preventing said shunt across said actuation component in the presence of a cycle modulation off condition;

a logic control monitor network responsive to said first logic control condition to provide a lamp on condition;

a cycle state monitor network responsive to said a.c. source to derive a cycle state signal corresponding with the instantaneous wave shape defining amplitude of each said half cycle; and a processor responsive, when activated from an inactive to an active state, to the commencement of said lamp on condition of said logic control monitor network, and to said cycle state signal to generate said cycle modulation on condition for a predetermined soft start interval effecting a soft start characterized energization of said incandescent lamp.

2. The conservation circuit of claim 1 in which said processor exhibits said cycle modulation off condition when in said inactive state.

3. The conservation circuit of claim 1 in which said processor is responsive to said cycle state signal to determine the commencement of each said half cycle.

4. The conservation circuit of claim 1 including:

a voltage level monitor network responsive to said a.c. source for deriving a voltage level output corresponding with said given voltage level, said processor being further responsive, when activated, to said voltage level output to derive said predetermined soft start interval in correspondence therewith.

5. The conservation circuit of claim 4 in which said processor includes memory retaining a soft start look-up table having soft start values corresponding with soft start defining intervals for a sequence of source voltage levels; and said processor is responsive, when in said active state, to said voltage level output to derive a said soft start value corresponding there with.

6. The conservation circuit of claim 5 in which said processor is responsive to adjust said soft start value for a number of cycles of said a.c. source in a manner progressively diminishing the extent of said predetermined interval of said cycle modulation on condition.

7. The conservation circuit of claim 1 in which:

said actuating component is a diode emitting radiation upon application of current from a control d.c. source thereto in response to said first logic control condition;

said solid state shunt switch comprises a PNP transistor having its emitter and collector electrodes coupled across said diode in said shunt defining relationship, and having its base coupled through a control network including a base-connected resistor coupled with said control d.c. source, and a coupling capacitor, in turn connected for response to said cycle modulation on condition to turn said PNP transistor on, said control network biasing said PNP transistor off in the presence of said cycle modulation off condition.

8. The conservation circuit of claim 1 including:

a voltage level monitor network responsive to said a.c. source for deriving a voltage level output corresponding with said given voltage level; and said processor is responsive, when in said active state, to said voltage level output, subsequent to said soft start characterized energization of said incandescent lamp and in the continued presence of said first logic control condition, to generate said cycle modulation on condition for a predetermined regulation interval effecting an energization of said incandescent lamp at a predetermined regulated voltage level less than said given voltage level.

9. The conservation circuit of claim 8 in which:

said processor includes memory retaining a regulator look-up table having regulator values corresponding with regulator defining intervals for a sequence of a.c. source voltage levels and, said processor is responsive to access said regulator look-up table and acquire a said regulator value corresponding with said given voltage level to derive said predetermined regulation interval.

10. A method for conserving the electrical power consumption and life span of lamps employed within traffic signals incorporating replaceable solid-state load switches, each employing a triac gatable to apply current from an a.c. source to an incandescent lamp at a given voltage level, an optoisolator driver including an emitting diode coupled with a control d.c. source and responsive to a logic control on condition to be energized from said control d.c. source to effect gating of said triac, comprising the steps of:

monitoring said a.c. source to determine the value of said given voltage level;

monitoring for the presence of said logic control on condition;

monitoring said a.c. source and determining the occurrence of the commencement of each half-cycle thereof;

providing a solid-state shunt switch coupled in shunting relationship across said emitting diode, having an on state inhibiting the said energization of said emitting diode and having an off state permitting the said energization of said emitting diode;

providing a shunt drive network coupled with said shunt switch, including a coupling capacitor and at least one resistor coupled with said control d.c. source, normally biasing said shunt switch into said off state and responsive to a cycle modulation on condition effect said shunt switch on state;

determining an energy conserving optimum voltage value for carrying out the energization of said incandescent lamp;

retaining regulator values for a sequence of a.c. source voltage levels in computer memory, each said retained regulator value corresponding with a regulation interval required in applying said cycle modulation on condition for each half cycle of a said a.c. source of said sequence to effect application of said optimum voltage value to said incandescent lamp;

accessing said memory to obtain an accessed regulator value corresponding with said value of said given voltage level; and applying said cycle modulation on condition commencing with the said occurrence of each half-cycle of said a.c. source for an interval corresponding with said accessed regulator value, in the presence of said logic control on condition, to effect application of said a.c. source to said incandescent lamp at said optimum voltage value.

11. The method of claim 10 including the steps of:

retaining initial soft start values for a sequence of a.c. source voltage levels in computer memory, each said retained soft start value corresponding with an initial soft start interval required in applying said cycle modulation on condition for each half-cycle of a said a.c. source of said sequence to effect commencement of a soft start for said incandescent lamp;

accessing said memory to obtain an accessed initial soft start value corresponding with said value of said given voltage level;

applying said cycle modulation on condition commencing with the half-cycles of an initial cycle of said a.c. source for an interval corresponding with said accessed initial soft start value at the commencement of said logic control condition;

decrementing said accessed initial soft start value by a predetermined value; and applying said cycle modulation on condition for each half cycle of a next succeeding cycle of said a.c. source for an interval corresponding with said decremented accessed initial soft start value, in the presence of said logic control on condition.

12. A solid state load switch of a variety removably connected with a control output of a traffic control logic circuit, responsive to a logic control on condition to energize an incandescent lamp from an a.c. source exhibiting a given voltage level and half-cycle characteristic comprising:

a thyristor switch connectable with said a.c. source and said lamp and gatable from an off to an on condition to effect energization of said lamp by said a.c. source;

a driver having a solid-state bilateral switch coupled in gating relationship with said thyristor switch and actuable to gate said thyrister switch into conduction optically by an optically coupled emitting diode when said emitting diode is energized, said emitting diode being electrically connectable between a control d.c. source and said control logic circuit control output and energizable in response to said logic control on condition;

a solid-state shunt switch coupled in shunting relationship across said emitting diode, having an on condition applying a shunt across said emitting diode preventing said energization thereof and a normally off condition enabling said energization;

a shunt drive network coupled with said shunt switch including a coupling capacitor and bias resistor responsive to said control d.c. source to maintain said shunt switch in said normally off condition and responsive to a cycle modulation on condition to derive said shunt switch on condition;

a logic control monitor network responsive to said first logic control on condition to provide a lamp on condition;

a cycle state monitor network responsive to said a.c. source to derive a cycle state signal corresponding with the instantaneous wave shape defining amplitude of said a.c. source;

a voltage level monitor network responsive to said a.c. source for deriving a voltage level output corresponding with said given voltage level;

a processor, responsive to said lamp on condition of said logic control monitor network, said cycle state and said voltage level output to generate said cycle modulation on condition for a predetermined regulation interval during each said half cycle effecting an energization of said incandescent lamp at a predetermined regulator voltage level less than said given voltage level.

13. The solid state load switch of claim 12 in which said processor is responsive to effect said shunt drive network maintenance of said shunt switch normally off condition when said given voltage level is less than said regulator voltage level.

14. The solid state load switch of claim 13 in which said processor is responsive to effect said shunt drive network maintenance of said shunt switch off condition when said given voltage level is less than said regulator voltage level.

15. The solid state load switch of claim 12 in which said processor includes memory retaining a regulator look-up table having regulator values corresponding with regulator defining intervals for a sequence of source voltage levels, said processor further being responsive to access said regulator look-up table and acquire a said regulator value corresponding with said given voltage level to derive said predetermined regulation interval.

16. The solid state load switch of claim 12 in which said processor is responsive to the commencement of said lamp on condition of said logic control monitor circuit to generate said cycle modulation on condition for a predetermined soft start interval effecting a soft start characterized energization of said incandescent lamp.

17. The solid state load switch of claim 16 in which said processor includes soft start memory retaining a soft start look-up table having soft-start values corresponding with soft-start defining intervals for a sequence of source voltage levels, said processor being further responsive to said voltage level output to derive a said soft start value corresponding therewith.

18. The solid state load switch of claim 17 in which said processor is responsive to adjust said soft start value for a number of cycles of said a.c. source in a manner progressively diminishing the extent of said predetermined interval of said cycle modulation on condition.

19. The solid state load switch of claim 18 in which said processor is responsive to adjust said soft start value until the soft start interval corresponding therewith is equivalent to said predetermined regulation interval and, thereafter to generate said cycle modulation on condition for said predetermined regulation interval in the continued presence of said lamp on condition.

20. The solid state load of claim 19 in which said processor includes regulator memory retaining a regulator look-up table having regulator values corresponding with regulator defining intervals for a sequence of source voltage levels, said processor further being responsive to access said regulator look-up table and acquire a said regulator value corresponding with said given voltage level to derive said predetermined regulation interval.

* * * * *